US005374513A

United States Patent [19]

Ohzeki et al.

[11] Patent Number: 5,374,513

[45] Date of Patent: Dec. 20, 1994

[54] SILVER HALIDE PHOTOGRAPHIC LIGHT-SENSITIVE MATERIAL

[75] Inventors: Katsuhisa Ohzeki; Hiroyuki Asanuma, both of Kanagawa, Japan

[73] Assignee: Fuji Photo Film Co., Ltd., Kanagawa, Japan

[21] Appl. No.: 990,520

[22] Filed: Dec. 15, 1992

[30] Foreign Application Priority Data

Dec. 16, 1991 [JP] Japan ..... 3-332105
Aug. 12, 1992 [JP] Japan ..... 4-236511

[51] Int. Cl.[5] ..... G03C 1/06

[52] U.S. Cl. ..... 430/612; 430/613; 430/607; 430/608; 430/372; 430/551

[58] Field of Search ..... 430/612, 613, 608, 607, 430/372, 551

[56] References Cited

U.S. PATENT DOCUMENTS 2,839,405 6/1958 Jones .
5,114,837 5/1992 Ogawa ..... 430/505
5,221,604 6/1993 Mifune et al. ..... 430/612

FOREIGN PATENT DOCUMENTS 0263508 4/1988 European Pat. Off. .
0366418 5/1990 European Pat. Off. .
2015455 4/1970 France .
0215409 11/1984 Germany .
0215410 11/1984 Germany .
1079061 8/1967 United Kingdom .
1356141 6/1978 United Kingdom .
2029978 3/1980 United Kingdom .

*Primary Examiner*—Janet C. Baxter
*Assistant Examiner*—Geraldine Letscher
*Attorney, Agent, or Firm*—Sughrue, Mion, Zinn, Macpeak & Seas

[57] ABSTRACT

A silver halide photographic light-sensitive material is disclosed. The light-sensitive material comprises a spectrally sensitized silver halide emulsion layer and a non-light-sensitive layer provided on a support. According to the present invention, the silver halide emulsion layer or the non-light-sensitive layer contains a complex of Ni, Co, Mn or Zn with a nitrogen-containing heterocyclic compound represented by the following formula:

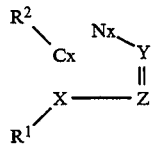

wherein

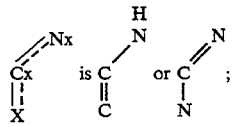

Y is $CR^3$ or N; Z is $CR^4$ or N; each of $R^1$, $R^2$, $R^3$ and $R^4$ independently is hydrogen, a halogen atom, hydroxyl, amino, hydroxyamino, cyano, an alkyl group, an aryl group, an alkylthio group, an alkylamino group, an arylamino group, an alkoxycarbonyl group or an acylamino group; $R^1$ and $R^2$ with X and Cx may form benzene ring or a six-membered nitrogen-containing heterocyclic ring; and the benzene ring or the six-membered nitrogen-containing heterocyclic ring may be substituted with a halogen atom, hydroxyl, amino, hydroxyamino, cyano, an alkyl group, an aryl group, an alkylthio group, an alkylamino group, an arylamino group, an alkoxycarbonyl group or an acylamino group.

16 Claims, No Drawings

SILVER HALIDE PHOTOGRAPHIC LIGHT-SENSITIVE MATERIAL

FIELD OF THE INVENTION

The present invention relates to a silver halide photographic light-sensitive material. Particularly, the invention relates to a silver halide light-sensitive material comprising a spectrally sensitized silver halide emulsion layer and a non-light-sensitive layer provided on a support.

BACKGROUND OF THE INVENTION

Silver halide photographic light-sensitive materials are often stored for a long period from preparation to use. The storage period sometimes exceeds 1 year. Therefore, the qualities of the photographic light-sensitive materials are required to be stable, even after stored for a long period. Under the requirement, various stabilizers have been proposed for the photographic light-sensitive materials. The stabilizers are described in detail in E. J. Birr, "STABILIZATION OF PHOTOGRAPHIC SILVER HALIDE EMULSIONS" (Focal Press).

Typical stabilizers are nitrogen-containing heterocyclic compounds. The nitrogen-containing heterocyclic compounds have an effect of preventing fog to stabilize photographic properties while the photographic light-sensitive material is prepared, stored or processed. Details of the nitrogen-containing heterocyclic compounds are described in Research Disclosure, vol. 307, pp. 866 and 869 (1989).

Most of the nitrogen-containing heterocyclic compounds function as the stabilizers when they are adsorbed on silver halide grains. Accordingly, an adsorption promoting group such as mercapto is often introduced into the nitrogen-containing heterocyclic compounds. A nitrogen-containing mercapto heterocyclic compound, however, sometimes reduces a sensitivity of the silver halide emulsion layer.

The problem of the nitrogen-containing mercapto heterocyclic compound has been solved by inventions described in British Patents No. 1079061 and No. 1289424. In the photographic material described in each of those publications, a nitrogen-containing mercapto heterocyclic compound is used in combination with a salt of silver, mercury, cadmium, copper, lead, nickel or cobalt. The metal salt has a function of preventing reduction of sensitivity caused by the nitrogen-containing mercapto heterocyclic compound.

By the way, spectral sensitizing dyes function when they are adsorbed on the silver halide grains. The stabilizers are competitive with the sensitizing dyes with respect to adsorption on the silver halide grains. Accordingly, the stabilizers make the dyes desorbed from the silver halide grains. As a result, the spectral sensitivity of the emulsion is reduced. The influence of a stabilizer is very serious when the silver halide grains have a low content of silver iodide, since the sensitizing dyes are particularly adsorbed on silver iodide rather than silver chloride or silver bromide.

SUMMARY OF THE INVENTION

In the photographic materials described in British Patents No. 1079061 and No. 1289424, the metal salt prevents reduction of sensitivity of the emulsion directly caused by a nitrogen-containing heterocyclic compound. According to studies of the present inventors, however, a problem of reduction of spectral sensitivity of the emulsion caused by desorption of a dye has been scarcely solved yet. Further, the present inventors have found that the nitrogen-containing mercapto heterocyclic compounds disclosed in the publications have high adsorptivity on the silver halide grains. Therefore, the heterocyclic compounds markedly inhibit adsorption of a spectrally sensitizing dye on the silver halide grains.

An object of the present invention is to provide a silver halide photographic light-sensitive material containing a stabilizer which scarcely inhibits adsorption of a spectrally sensitizing dye on the silver halide grains.

The present invention provides a silver halide light-sensitive material comprising a spectrally sensitized silver halide emulsion layer and a non-light-sensitive layer provided on a support, wherein the silver halide emulsion layer or the non-light-sensitive layer contains a complex of Ni, Co, Mn or Zn with a nitrogen-containing heterocyclic compound represented by the following formula:

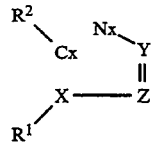

wherein

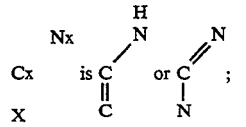

Y is $CR^3$ or N; Z is $CR^4$ or N; each of $R^1$, $R^2$, $R^3$ and $R^4$ independently is hydrogen, a halogen atom, hydroxyl, amino, hydroxyamino, cyano, an alkyl group, an aryl group, an alkylthio group, an alkylamino group, an arylamino group, an alkoxycarbonyl group or an acylamino group; $R^1$ and $R^2$ with X and Cx may form benzene ring or a six-membered nitrogen-containing heterocyclic ring; and the benzene ring or the six-membered nitrogen-containing heterocyclic ring may be substituted with a halogen atom, hydroxyl, amino, hydroxyamino, cyano, an alkyl group, an aryl group, an alkylthio group, an alkylamino group, an arylamino group, an alkoxycarbonyl group or an acylamino group.

Ni, Co, Mn or Zn is preferably contained in the complex in an amount of $1\times10^{-4}$ to $3\times10^{-2}$ mol based on 1 mol of silver.

The silver halide emulsion layer preferably contains silver halide grains having a silver iodide content of not more than 1 mole percentage.

All layers provided on the support on the side of the silver halide emulsion layer preferably totally contain gelatin in an amount of not more than 1.8 g based on 1 g of silver.

The photographic light-sensitive material of the present invention is characterized in that a novel stabilizer is used. The novel stabilizer is the complex of Ni, Co, Mn or Zn with a specific nitrogen-containing heterocyclic compound represented by the above formula.

According to the studies of the present inventors, the above-mentioned complex serves as an excellent stabilizer. This complex scarcely inhibits adsorption of a spectrally sensitizing dye on the silver halide grains, as compared with the conventional stabilizers. Therefore, the photographic light-sensitive material of the invention is free from reduction of spectral sensitivity of the silver halide emulsion even though using a stabilizer.

Further, the complex has excellent stabilizing functions such as a fogging-preventing function. Moreover, the complex does not directly lower sensitivity of the emulsion.

Accordingly, the photographic light-sensitive material of the invention has such excellent properties that fogging is prevented, photographic properties are stabilized, and the sensitivity (including spectral sensitivity) of the emulsion is high.

DETAILED DESCRIPTION OF THE INVENTION

The nitrogen-containing heterocyclic compound is represented by the following formula:

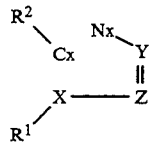

wherein

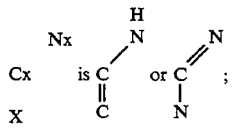

Y is $CR^3$ or N; Z is $CR^4$ or N; each of $R^1$, $R^2$, $R^3$ and $R^4$ independently is hydrogen, a halogen atom, hydroxyl, amino, hydroxyamino, cyano, an alkyl group, an aryl group, an alkylthio group, an alkylamino group, an arylamino group, an alkoxycarbonyl group or an acylamino group; $R^1$ and $R^2$ with X and Cx may form benzene ring or a six-membered nitrogen-containing heterocyclic ring; and the benzene ring or the six-membered nitrogen-containing heterocyclic ring may be substituted with a halogen atom, hydroxyl, amino, hydroxyamino, cyano, an alkyl group, an aryl group, an alkylthio group, an alkylamino group, an arylamino group, an alkoxycarbonyl group or an acylamino group.

At least one of X, Y and Z preferably is nitrogen. In other words, the five-membered ring of the above formula preferably is a diazole ring (pyrazole ring, imidazole ring), a triazole ring (1,2,3-triazole ring, 1,2,4-triazole ring) or a tetrazole ring.

$R^1$ and $R^2$ with X and Cx preferably form benzene ring or a six-membered nitrogen-containing heterocyclic ring. In other words, the nitrogen-containing heterocyclic compound preferably has an azaindene ring. Examples of the azaindene rings include purine ring, indazole ring, benzimidazole ring, benzotriazole ring, 1,3a,7-triazaindene ring, 1,2,3a,7-tetrazaindene ring, 1,3,3a,7-tetrazaindene ring and 1,2,3,3a,7-pentazaindene ring.

Each of $R^1$, $R^2$, $R^3$ and $R^4$ preferably has 20 or less carbon atom, more preferably 10 or less carbon atom, and most preferably 6 or less carbon atom. Likewise, the substituent group of the benzene ring or the nitrogen-containing heterocyclic ring of 6 members preferably has 20 or less carbon atom, more preferably 10 or less carbon atom, and most preferably 6 or less carbon atom. Each of $R^1$, $R^2$, $R^3$, $R^4$ and the substituent group of the benzene ring or the six-membered nitrogen-containing heterocyclic ring may be further substituted with a halogen atom, hydroxyl, amyl, hydroxyamino or cyano.

At least one of $R^1$, $R^2$, $R^3$, $R^4$ and the substituent group of the benzene ring or the six-membered nitrogen-containing heterocyclic ring is preferably hydroxyl.

In the invention, a hydroxyazaindene, specifically a hydroxytetrazaindene is preferably used as the nitrogen-containing heterocyclic compound.

Examples of the nitrogen-containing heterocyclic compounds are given below.

| | | |
|---|---|---|
| (1) | 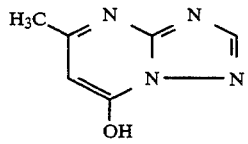 | 4-Hydroxy-6-methyl-1,3,3a,7-tetrazaindene |
| (2) | 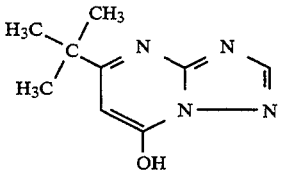 | 4-Hydroxy-6-t-butyl-1,3,3a,7-tetrazaindene |
| (3) | 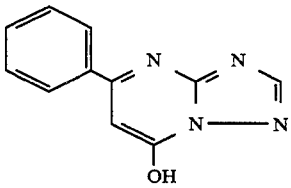 | 4-Hydroxy-6-phenyl-1,3,3a,7-tetrazaindene |
| (4) | 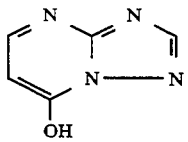 | 4-Hydroxy-1,3,3a,7-tetrazaindene |
| (5) | 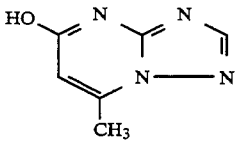 | 4-Methyl-6-hydroxy-1,3,3a,7-tetrazaindene |
| (6) | 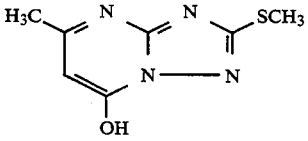 | 4-Methylthio-4-hydroxy-6-methyl-1,3,3a,7-tetrazaindene |
| (7) | 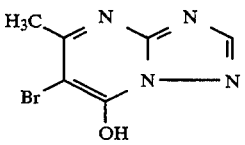 | 4-Hydroxy-5-bromo-6-methyl-1,3,3a,7-tetrazaindene |

-continued

| | | |
|---|---|---|
| (8) | 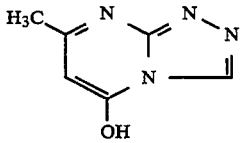 | 4-Hydroxy-6-methyl-1,2,3a,7-tetrazaindene |
| (9) | 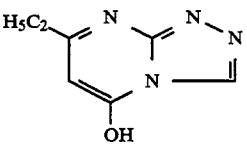 | 4-Hydroxy-6-ethyl-1,2,3a,7-tetrazaindene |
| (10) | 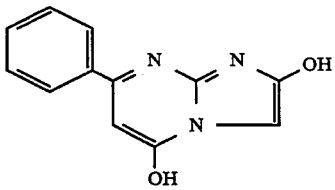 | 2,4-Dihydroxy-6-phenyl-1,3a,7-triazaindene |
| (11) | 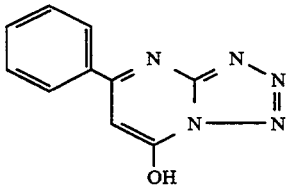 | 4-Hydroxy-6-phenyl-1,2,3,3a,7-pentazaindene |
| (12) | 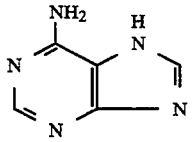 | Adenine |
| (13) | 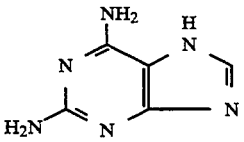 | Guanine |
| (14) | 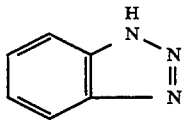 | Benzotriazole |
| (15) | 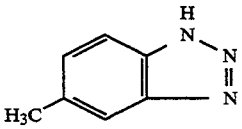 | 5-Methyl-benzotriazole |
| (16) | 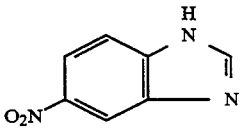 | 5-Nitro-benzoimidazole |
| (17) | 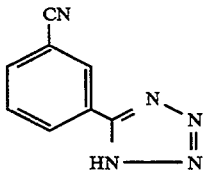 | 5-(m-Cyano-phenyl)tetrazole |

-continued

| | | |
|---|---|---|
| (18) | 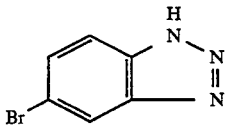 | 5-Bromo-benzotriazole |
| (19) | 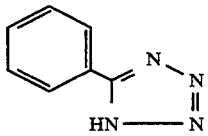 | 5-Phenyltetrazole |
| (20) | 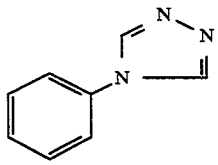 | 4-Phenyl-1,2,4-triazole |
| (21) | 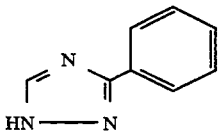 | 3-Phenyl-1,2,4-triazole |
| (22) | 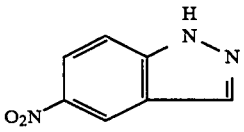 | 5-Nitroindazole |
| (23) | 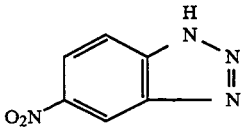 | 5-Nitro-benzotriazole |
| (24) | 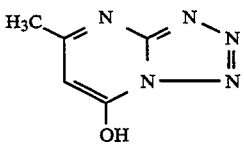 | 4-Hydroxy-6-methyl-1,2,3,3a,7-pentazaindene |

These nitrogen-containing heterocyclic compounds have already been known as stabilizers or antifogging agents.

Nitrogen-containing heterocyclic compounds generally have tautomerism. In the nitrogen-containing heterocyclic compound of the invention, it is enough that at least one of the plural tautomers satisfies the definition of the formula. For example, each of the above-mentioned 4-hydroxy-6-methyl-1,3,3a,7-tetrazaindene (1) and guanine (13) includes an enol type and a keto type shown below. Definition and examples are shown in the specification with respect to the enol type.

(1) 4-hydroxy-6-methyl-1,3,3a,7-tetrazaindene

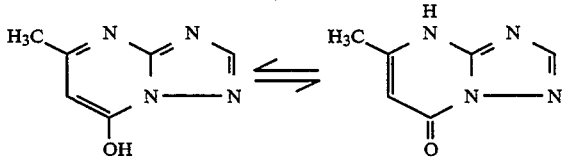

Enol type Keto type

(13) Guanine

-continued

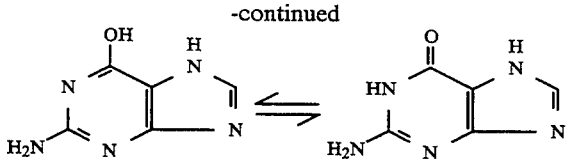

Enol type Keto type

The nitrogen-containing heterocyclic compound is used preferably in an amount of $1\times10^{-5}$ to $1\times10^{-1}$ mol, and more preferably $1\times10^{-4}$ to $1\times10^{-2}$ mol based on 1 mol of silver.

In the invention, the nitrogen-containing heterocyclic compound forms a complex with Ni, Co, Mn or Zn. Preferred are Ni, Co and Mn. Most preferred is Ni.

Nickel, cobalt, manganese or zinc is preferably used in the form of a metallic compound rather than the form of the metal itself. The metallic compound preferably is a salt. In the case of using a salt of Ni, Co, Mn or Zn, the complex used for the invention is a complex salt.

The metal salt for a complex preferably is water-soluble. The metal salt may contain water of crystallization. Examples of counter ions of the metal salts include a halide ion, phosphate ion, nitrate ion, sulfate ion, an amidosulfate ion, a sulfonate (e.g., benzenesulfonate) ion and a carboxylate (e.g., formate, acetate, oxalate, lactate, salicylate) ion.

Examples of nickel salts include $Ni(NO_3)_2.6H_2O$, $NiCl_2.6H_2O$, $NiSO_4.6H_2O$, $(CH_3COO)_2Ni.4H_2O$, $NiBr_2$, $C_2O_4Ni$, $(CH_3COCHCOCH_3)_2Ni.H_2O$, $(H_2NSO_3)_2Ni.4H_2O$, $(NH_4)_2Ni(SO_4)_2.6H_2O$, $Ni(HCOO)_2.2H_2O$ and $(C_6H_5SO_3)_2Ni.6H_2O$.

Examples of cobalt salts include $Co(CH_3COO)_2.4H_2O$, $Co(CH_3COCHCOCH_3)_2.2H_2O$, $CoBF_2.6H_2O$, $CoCl_2.6H_2O$, $CoSO_4(NH_4)SO_4.6H_2O$, $Co(NO_3)_2.6H_2O$, $Co_3(PO_4)_2.8H_2O$ and $CoSO_4.7H_2O$.

Examples of manganese salts include $Mn(CH_3COO)_2.4H_2O$, $Mn(CH_3COCHCOCH_3)_2$, $Mn(NH_4)_2(SO_4)_2.6H_2O$, $Mn(C_6H_5COO)_2.4H_2O$, $MnCl_2.4H_2O$, $Nb(HCOO)_2.2H_2O$, $Mn(NO_3)_2.2H_2O$, $MnC_2O_4.\frac{1}{2}H_2O$, $Mn(H_2PO_4).4H_2O$ and $MnSO_4.nH_2O$ (n=4, 5 or 6).

Examples of zinc salts include $Zn(CH_3COO)_2.2H_2O$, $ZnBr_2$, $ZnCl_2$, $Zn(C_3H_5O_3)_2.3H_2O$, $Zn(NO_3)_2.6H_2O$, $Zn[C_6H_4(OH)SO_3]_2.8H_2O$, $Zn_3(PO_4).4H_2O$, $Zn[C_6H_4(OH)COO]_2.3H_2O$ and $ZnSO_4.7H_2O$.

Ni, Co, Mn or Zn (particularly a metallic compound thereof) is preferably used in the complex in an amount of 1/6 to 100 mol, and more preferably $\frac{1}{3}$ to 10 mol, based on 1 mol of the heterocyclic compound. Further, Ni, Co, Mn or Zn (particularly a metallic compound thereof) is used preferably in an amount of $1\times10^{-4}$ to $3\times10^{-2}$ mol, and more preferably $3\times10^{-4}$ to $10^{-2}$ mol, based on 1 mol of silver.

The metallic compound may initially be mixed with the nitrogen-containing heterocyclic compound to form a complex, and then the mixture may be added to any of coating solutions for layers of the photographic light-sensitive material. Crystallite of the complex may be added to a coating solution for the photographic light-sensitive material. Otherwise, the nitrogen-containing heterocyclic compound and the metallic compound are simultaneously added to a coating solution to form a complex in the coating solution.

The complex used for the invention is added to the spectrally sensitized silver halide emulsion layer or the non-light-sensitive layer. The non-light-sensitive layer includes an overcoating layer, an undercoating layer and an intermediate layer. The non-light-sensitive layer may be a functional layer such as a protective layer or a filter layer.

The complex is preferably added to the silver halide emulsion layer rather than the non-light-sensitive layer. The complex is preferably added to the silver halide emulsion after chemical sensitization of the emulsion is completed. The complex is more preferably added after chemical sensitization and spectral sensitization of the emulsion are completed.

The silver halide emulsion layer usually contains a protective colloid. The emulsion layer or the non-light-sensitive layer usually contains a binder. Gelatin is the most advantageous protective colloid or binder. Gelatin derivatives, gelatin graft polymers and hydrophilic polymers other than gelatin are also available as the protective colloid or the binder.

Gelatins include lime-treated gelatin, acid-treated gelatin, enzyme-treated gelatin (described in "Bull. Soc. Sci. Phot. Japan", No. 16, p. 30, 1966), hydrolysis products of gelatin and enzyme decomposition products of gelatin.

The total amount of gelatin contained in all layers on the support on the side of the silver halide emulsion layer is preferably not more than 1.8 g based on 1 g of silver. The total amount of gelatin is preferably reduced as described above to process the silver halide photographic light-sensitive material quickly. In the case of reducing the total amount of gelatin, it is necessary to adjust the amount of the complex, and particularly the metal salt should be used in the above-defined preferred amount.

The gelatin derivatives can be obtained by reacting gelatin with various compounds. Examples of the compounds include acid halides, acid anhydrides, isocyanates, bromoacetic acid, alkanesultones, vinyl sulfonamides, maleimide compounds, polyalkylene oxides and epoxy compounds. The gelatin derivatives are described in U.S. Pat. Nos. 2,614,928, 3,132,945, 3,186,846 and 3,312,553, U.K. Patents No. 861,414, 1,033,189 and 1,005,784, and Japanese Patent Publication No. 42 (1967) 26845.

The gelatin graft polymers can be obtained by graft-polymerizing gelatin with homopolymers or copolymers of vinyl monomers. Examples of the vinyl monomers include acrylic acid, methacrylic acid, acrylic ester, methacrylic ester, acrylamide, methacrylamide, acrylonitrile and styrene. Preferred are vinyl monomers having a certain compatibility with gelatin, for example, acrylic acid, methacrylic acid, acrylamide, methacrylamide and hydroxyalkyl methacylate. The gelatin graft polymers are described in U.S Pat. No. 2,763,625, 2,831,767 and 2,956,884.

The hydrophilic polymers other than gelatin include proteins, polysaccharides and synthetic hydrophilic polymers. Examples of proteins include albumin and casein. Examples of polysaccharides include cellulose derivatives (e.g., hydroxyethyl cellulose, carboxymethyl cellulose and cellulose sulfate), alginic acid soda and starch derivatives. Examples of the synthetic hydrophilic polymers include polyvinyl alcohol, polyvinyl alcohol partial acetal, poly-N-vinylpyrrolidone, polyacrylic acid, polymethacrylic acid, polyacrylamide, polyvinyl imidazole, polyrvinyl pyrazole and copolymers thereof. The synthetic hydrophilic polymers are described in West German Patent Application (OLS) No. 2,312,708, U.S. Pat. Nos. 3,620,751 and 3,879,205, and Japanese Patent Publication No. 43(1968) 7561.

Examples of the silver halide used in the invention include silver bromide, silver iodobromide, silver iodochlorobromide, silver chlorobromide and silver chloride. Silver halide grains having a low content of silver iodide are preferred because they are high in the developing speed and they hardly give staining of processing solutions caused by iodine. However, such grains have a problem that adsorption of sensitizing dyes is weak compared with grains having a high convent of silver iodide. Accordingly, the sensitizing dyes are easily desorbed with a conventional stabilizer. This problem can be solved by using the complex of the invention as a stabilizer. The content of the silver iodide in the silver halide grains is preferably not more than 1 mole percentage, and more preferably not more than 0.5 mole percentage.

In the case of using tabular silver halide grains, a mean value of the grain diameters (diameter of a circle having the same area as that of a projected area of the grain) is preferably in the range of 0.3 to 5 μm, and more preferably in the range of 0.5 to 3 μm.

A mean grain size (diameter of a sphere having the same volume as that of the grains) of the silver halide grains is in the range of 0.1 to 3 μm. The grain size distribution may be either narrow or wide.

The silver halide grains may be those having a regular crystal form such as cube or octahedron. Further, grains having an irregular crystal form such as spherical form or tabular form are available. A mixture of grains having various crystal forms is also available.

Individual silver halide grains may have different phases between inside and outside. A silver halide grain having a uniform phase is also available. In the silver halide grains, a latent image is generally formed on the surface of the grain. The surface latent image type silver halide emulsion includes an ordinary negative type emulsion and a pre-forged direct reversal type emulsion. Such a grain that a latent image is formed inside the grain is also useful in the invention. The internal latent image type emulsion is used as a direct reversal type emulsion.

Processes for preparing a silver halide emulsion are described in P. Glafkides, "Chimie et Physique Photographique" (Paul Montel, 1967); G. F. Duffin, "Photographic Emulsion Chemistry" (The Focal Press, 1966); and V. L. Zelikman et al, "Making and Coating Photographic Emulsion" (The Focal Press, 1964). Any of acid process, neutral process and ammonia process may be employed. A soluble silver salt can be reacted with a soluble halogen salt according to any of one side mixing method, simultaneous mixing method and a combination of them.

Further, a process in which grains are formed in the presence of excess silver ion (so-called "reversal mixing method") is also available. A so-called "controlled double jet method" which is a simultaneous mixing method, can also be used. In this method, a pAg value of the liquid phase in which silver halide is formed is kept at a constant value. According to the controlled double jet method, there can be obtained a silver halide emulsion in which silver halide grain has a regular crystal form and the grain size is almost uniform.

Extremely fine grains of silver halide may be added to the emulsion to grow the silver halide grains (cf., Japanese Patent Provisional Publications No-1(1989)183644, No. 1(1989)-18345 and No. 1(1989)-183417). A size of the extremely fine grain is preferably not more than 0.2 μm, more preferably not more than 0.1 μm, and most preferably not more than 0.05 μm.

A mixture of two or more kinds of silver halide emulsions separately prepared is also available.

Formation of silver halide grains or physical ripening may be carried out in the presence of cadmium salt, zinc salt, lead salt, thallium salt, iridium salt or its complex salt, rhodium salt or its complex salt, iron salt or its complex salt. Further, those stages may be carried out in the presence of a spectrally sensitizing dye.

The silver halide grains may be formed in the presence of a silver halide solvent. Examples of the silver halide solvents include thiocyanate, thioether compound, thiazolidinethione, substituted tetrathiourea, ammonia and crown ether.

After the grain formation, the silver halide emulsion is generally subjected to physical ripening, desalting and chemical ripening.

A monodispersed emulsion can be obtained where the physical ripening is carried out in the presence of a silver halide solvent. In the monodispersed emulsion, the silver halide grain has a regular crystal form, and the grain size is almost uniform. Examples of the silver halide solvents include ammonia, potassium rhodanate, thioethers and thione compounds (cf., U.S. Pat. No. 3,271,157, and Japanese Patent Provisional Publications No. 51(1976)-12360, No. 53(1978)-82408, No. 53(1978)-144319, No. 54(1979)-100717 and No. 54(1979)-155828).

A soluble silver salt can be removed from the emulsion before or after the physical ripening according to a noodle washing method, a flocculation sedimentation method or an ultrafiltration method.

Chemical sensitization is carried out according to sulfur sensitization, selenium sensitization, reduction sensitization, precious metal sensitization or a combination thereof.

For the sulfur sensitization, compounds containing sulfur capable of reacting with active gelatin or silver (e.g., thiosulfates, thioureas, rhodanines) are used. Reducing substances (e.g., stannous salt, amines, hydrazine derivatives, formamidine sulfonate, silane compound) are used for the reduction sensitization. For the precious metal sensitization, metallic compounds (e.g., gold complex salts and complex salts of metals belonging to VIII group of periodic table such as Pt, It, Pd, Rh and Fe) are used.

The silver halide emulsion layer and the non-light-sensitive layer (including a back layer) usually are hydrophilic colloidal layers. Inorganic or organic hardening agents may be added to these hydrophilic colloidal layers. Examples of the hardening agents include chromiun salt, aldehydes (e.g., formaldehyde, glyoxal and glutaric aidehyde), N-methylol compounds (e.g., dimethylol urea), active halogen compounds (e.g., 2,4-dichloro-6-hydroxy-1,3,5-triazine and its sodium salt), active vinyl compounds (e.g., 1,3-bisvinylsulfonyl-2-propanol, 1,2-bis(vinylsulfonylacetamide)ethane, bis(-vinylsulfonylmethyl)ether and vinyl polionets having a vinylsulfonyl group at a side chain), N-carbamoylpyridinium salts (e.g., (1-morpholinocarbonyl-3-pyridinio)methanesulfonate), and haloamidiniun salts (e.g., 1-(1-chloro-1-pyridinomethylene) pyrrolidium-2-naphthalenesulfonate). Active halogen compounds, active vinyl compounds, N-carbamoylpyridinium salts and haloamidinium salts are preferred because they rapidly harden the hydrophilic colloids such as gelatin. Particularly preferred are active halogen compounds and vinyl compounds, because they give stable photographic properties to the light-sensitive material.

The silver halide emulsion used for the invention is spectrally sensitized with a sensitizing dye. Examples of the sensitizing dyes include methine dyes, cyanine dyes, merocyanine dyes, complex cyanine dyes, complex merocyanine dyes, holopolar cyanine dyes, hemicyanine dyes, styryl dyes and hemioxonol dyes. Particularly useful are cyanine dyes, merocyanine dyes and complex merocyanine dyes.

The sensitizing dyes usually have basic heterocyclic nucleus.

The heterocyclic nuclei of the cyanine dyes include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, and condensed nuclei of these nuclei with alicyclic hydrocarbon ring or aromatic hydrocarbon ring. Examples of the condensed nuclei include indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus and quinoline nucleus.

The merocyanine dyes or the complex merocyanine dyes have a heterocyclic nucleus of 5 or 6 members having a ketomethylene structure. Examples of the heterocyclic nucleus of ketomethylene structure include pyrazoline-5-one nucleus, thiohydantoin nucleus, 2-thiooxazolidine-2,4-dione nucleus, thiazolidine-2,4-dione nucleus, rhodanine nucleus and thiobarbituric acid nucleus.

Dyes having a weak adsorbing property has an advantage that the dyes may be easily handled. These dyes are advantageously used in the present invention, since the invention solves the problem of the weak adsorbing property.

Two or more kinds of the sensitizing dyes may be used in combination. Combinations of the sensitizing dyes are often used for supersensitization. In addition to the sensitizing dyes, a substance which does not itself exhibit spectral sensitization effect or does not substantially absorb visible light but shows supersensitizing activity (supersensitizer) may be added to the silver halide emulsion. Examples of the supersensitizers include aminostilbenzene compounds substituted by nitrogen-containing heterocyclic group (see: U.S. Pat. Nos. 2,933,390 and 3,635,721), condensates of aromatic organic acid and formaldehyde (see: U.S. Pat. No. 3,743,510), cadmium salts and azaindene compounds. Combinations of the sensitizing dyes and the supersensitizers are described in U.S. Pat. Nos. 3,615,613, 3,615,641, 3,617,295 and 3,635,721.

Addition of the sensitizing dye is made preferably after initiation of the chemical sensitization, particularly preferably during the chemical sensitization.

The silver halide emulsion layer and the non-light-sensitive layer are coated on a support which is generally used for a photographic light-sensitive material. Examples of the support materials include flexible materials such as plastic films, papers and cloths; and rigid materials such as glass, ceramics and metals. Preferred flexible supports are plastic films, baryta layer and papers coated or laminated with α-olefin polymers. Examples of the plastics include cellulose nitrate, cellulose acetate, cellulose butyl acetate, polystyrene, polyvinyl chloride, polyethylene terephthalate and polycarbonate. Examples of the α-olefin polymers include polyester, polypropylene and an ethylenebutadiene copolymer.

The support may be colored with dyes or pigments. The support may be made black for light-shielding. The surface of the support is generally subjected to undercoating treatment to enhance adhesion between the support and the hydrophilic colloidal layer such as a silver halide emulsion layer. Before or after the undercoating treatment, the surface of the support may be subjected to glow discharge, corona discharge, irradiation with ultraviolet rays or flame treatment.

The silver halide photographic light-sensitive material of the invention may be prepared as a black and white light-sensitive material or a color light-sensitive material. Further, the photographic light-sensitive material of the invention may be prepared as a negative light-sensitive material or a positive light-sensitive material.

For the image formation, the photographic light-sensitive material is subjected to developing process, fixing process and drying process after imagewise exposure.

A developing solution used for the developing process contains a developing agent. Examples of the developing agents include dihydroxybenzenes (e.g., hydroquinone), 3-pyrazolidones (e.g., 1-phenyl-3-pyrazolidone) and arninophenols (e.g., N-methyl-p-aminophemol). Two or more kinds of the developing agents may be used in combination. The developing solution usually contains preservatives, alkali agents, pH buffers and antifogging agents, in addition to the developing agent. The developing solution may further contain dissolving aids, toning agents, development accelerators (e.g., quaternary salt, hydrazine and benzyl alcohol), surface active agents, antifoaming agents, hard water-softening agents, hardening agents (e.g., glutaric aidehyde) and viscosity imparting agents.

A fixing solution used for the fixing process contains a fixing agent. Examples of the fixing agents include thiosulfates, thiocyanates and organic sulfur compounds. The fixing solution may contain hardening agents. An example of the hardening agent is aluminum salt.

The above-mentioned processes may be carried out using an automatic developing machine. A roller conveying type automatic developing machine is preferably used (see: U.S. Pat. Nos. 3,025,779, 3,515,556, 3,573,914 and 3,647,459, and U.K. Patent No. 1,269,268).

EXAMPLE 1

Preparation of Tabular Grains (1) Having Silver Iodide Content of 0.83 Mole %

To 1 liter of water were added 4.5 g of potassium bromide, 20.6 g of gelatin and 2.5 cc of a 5% aqueous solution of thioether $HO(CH_2)_2S(CH_2)_2S(CH_2)_2OH$. To the resulting mixture in a container kept at 60° C. were added with stirring of the mixture 37 cc of an aqueous solution of silver nitrate (silver nitrate: 3.43 g) and 33 cc of an aqueous solution containing 2.97 g of potassium bromide and 0.363 g of potassium iodide according to a double jet method over 37 seconds. An aqueous solution containing 0.9 g of potassium bromide was added to the mixture, then the temperature of the mixture was raised to 70° C., and to the mixture was added 53 cc of an aqueous solution of silver nitrate (silver nitrate: 4.90 g) over 13 minutes. To the mixture was added 15 cc of a 25% ammonia aqueous solution to perform physical ripening at the same temperature for 20 minutes. To the mixture was further added 14 cc of a 100% acetic acid. Successively, to the resulting mixture were added an aqueous solution containing 133.3 g of silver nitrate and an aqueous solution of potassium bromide containing 0.6 mole % of potassium iodide over 35 minutes keeping a pAg value of 8.5 according to a controlled double jet method. Then, to the mixture were added 10 cc of a 2N potassium thiocyanate solution and fine grains of AgI (diameter: 0.07 μm) in an amount of 0.1 mole % based on the total amount of silver. After physical ripening at the same temperature for 5 minutes, the temperature of the mixture was lowered to 35° C. Thus, monodispersed tabular grains were obtained. The grains have a total content of silver iodide of 0.83 mole %, a mean diameter of projected area of 1.10 μm, a thickness of 0.165 μm and a coefficient of variation in diameter of 18.5%.

Then soluble salts were removed by a sedimentation method. The temperature of the reaction system was again raised to 40° C. To the reaction system were added 30 g of gelatin, 2.35 g of phenoxyethanol and 0.8 g of sodium polystyrenesulfonate as a thickening agent, and a pH value and a pAg value of the reaction system were adjusted to 5.90 and 8.25, respectively, using caustic soda and a silver nitrate solution.

Preparation of Tabular Grains (2) Having Silver Iodide Content of 1.67 Mole %

To 1 liter of water were added 4.5 g of potassium bromide, 20.6 g of gelatin and 2.5 cc of a 5% aqueous solution of thioether $HO(CH_2)_2S(CH_2)_2S(CH_2)_2OH$. To the resulting mixture in a container kept at 60° C. were added with stirring of the mixture 37 cc of an aqueous solution of silver nitrate (silver nitrate: 3.43 g) and 33 cc of an aqueous solution containing 2.97 g of potassium bromide and 0.363 g of potassium iodide according to a double jet method over 37 seconds. An aqueous solution containing 0.9 g of potassium bromide was added to the mixture, then the temperature of the mixture was raised to 70° C., and to the mixture was added 53 cc of an aqueous solution of silver nitrate (silver nitrate: 4.90 g) over 13 minutes. To the mixture was added 15 cc of a 25% ammonia aqueous solution to perform physical ripening at the same temperature for 20 minutes, and then to the mixture was added 14 cc of a 100% acetic acid. Successively, to the resulting mixture were added an aqueous solution containing 133.3 g of silver nitrate and an aqueous solution of potassium bromide containing 1.5 mole % of potassium iodide over 35 minutes keeping a pAg value of 8.5 according to a controlled double jet method. Then, to the mixture were added 10 cc of a 2N potassium thiocyanate solution and fine grains of AgI (diameter: 0.07 μm) in an amount of 0.1 mole % based on the total amount of silver. After physical ripening at the same temperature for 5 minutes, the temperature of the mixture was lowered to 35° C. Thus, monodispersed tabular grains were obtained. The grains have a total content of silver iodide of 1.67 mole %, a mean diameter of projected area of 1.15 μm, a thickness of 0.160 μm and a coefficient of variation in diameter of 19.8%.

Then soluble salts were removed by a sedimentation method. The temperature of the reaction system was again raised to 40° C. To the reaction system were added 30 g of gelatin, 2.35 g of phenoxyethanol and 0.8 g of sodium polystyrenesulfonate as a thickening agent, and a pH value and a pAg value of the reaction system were adjusted to 5.90 and 8.25, respectively, using caustic soda and a silver nitrate solution.

Chemical Sensitization

The above-prepared grains (1) and (2) were subjected to the following chemical sensitization with stirring and keeping at 56° C.

In the first place, 0.43 mg of thiourea dioxide was added to the grains and the resulting mixture was allowed to stand for 22 minutes to perform reduction sensitization. Then, to the mixture was added 500 mg of the following sensitizing dye, and was further added 1.1 g of an aqueous solution of calcium chloride. Successively, to the mixture were added 3.3 mg of sodium thiosulfate, 2.6 mg of chloroauric acid and 90 mg of potassium thiocyanate. After 40 minutes, the mixture was cooled to 35° C.

Thus, silver halide emulsions (1) and (2) were prepared.

(Sensitizing dye)

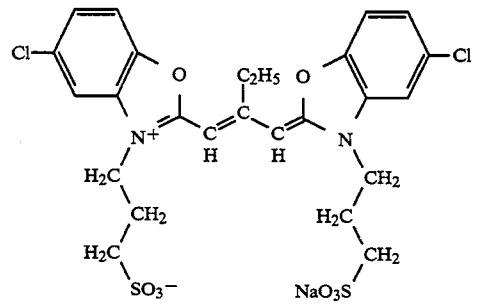

Preparation of Coating Solutions (A) to (E-2)

To the silver halide emulsion (1) or (2) were added the following chemicals in the following amounts per 1 mol of the silver halide to prepare a coating solution (A).

| | |
|---|---|
| 2,6-Bis(hydroxyamino)-4-diethylamino-1,3,5-triazine | 72 mg |
| Trimethylolpropane | 9 g |
| Dextran (average molecular weight: 39,000) | 18.5 g |
| Potassium polystyrenesulfonate (average molecular weight: 600,000) | 1.8 g |
| Compound (E-1) shown below | 10.9 g |
| Gelatin (the amount being adjusted so that the total amount to be coated on one side is 2.4 g/m$^2$) | |
| 1,2-Bis(vinylsulfonylacetamide)ethane (hardening agent, the amount being adjusted so that the swelling rate is 230%) | |

(E-1)

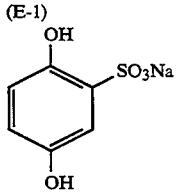

To the above coating solution (A) were added chemicals shown in Table 1 to prepare coating solutions (B-1) to (E-2).

TABLE 1

| Coating solution | Heterocyclic compound | Metal salt |
|---|---|---|
| (A) | None | None |
| (B-1) | Heterocyclic compound (1) | None |
| (B-2) | 1-Phenyl-5-mercaptotetrazole | None |
| (C-1) | Heterocyclic compound (1) | $Ni(NO_3)_2.6H_2O$ |
| (C-2) | 1-Phenyl-5-mercaptotetrazole | $Ni(NO_3)_2.6H_2O$ |
| (D-1) | Heterocyclic compound (1) | $Co(NO_3)_2.6H_2O$ |
| (D-2) | 1-Phenyl-5-mercaptotetrazole | $Co(NO_3)_2.6H_2O$ |
| (E-1) | Heterocyclic compound (1) | $MnCl_2.4H_2O$ |
| (E-2) | 1-Phenyl-5-mercaptotetrazole | $MnCl_2.4H_2O$ |

Amounts (each based on 1 mol of silver halide) of the chemicals shown in Table 1 are shown below. In each of the coating solutions, the same chemical was used in the same amount.

| | |
|---|---|
| Heterocyclic compound (1) | 0.15 g |
| 1-Phenyl-5-mercaptotetrazole | 0.178 g |
| $Ni(NO_3)_2.6H_2O$ | 2.90 g |
| $Co(NO_3)_2.6H_2O$ | 2.91 g |
| $MnCl_2.4H_2O$ | 1.97 g |

Preparation of a Complex Powder Dispersion

To 1 liter of a 0.2 mol aqueous solution (pH: 8.06) of the heterocyclic compound (1) according to the invention was added 1 liter of a 0.1 mol aqueous solution of $Ni(NO_3)_2.6H_2O$. Thus, a light blue solid was deposited. After this solid was separated by filtration and dried, the solid was subjected to ultrasonic dispersing in a 1% aqueous solution of gelatin. Thus, a complex powder dispersion was prepared.

Preparation of a Coating Solution (F)

To the aforementioned coating solution (A) was added the above-obtained dispersion containing 0.43 g of complex powder to prepare a coating solution (F).

Preparation of a Coating Solution for Forming a Surface Protective Layer

A coating solution for forming a surface protective layer was prepared using the following components in the following amounts.

| | |
|---|---|
| Gelatin | 0.966 $g/m^2$ |
| Sodium polyacrylate (average molecular weight: 400,000) | 0.023 $g/m^2$ |
| Compound (P-1) shown below | 0.013 $g/m^2$ |
| Compound (P-2) shown below | 0.045 $g/m^2$ |
| Compound (P-3) shown below | 0.0065 $g/m^2$ |
| Compound (P-4) shown below | 0.003 $g/m^2$ |
| Compound (P-5) shown below | 0.001 $g/m^2$ |
| Polymethyl methacrylate (mean particle diameter: 3.7 μm) | 0.087 $g/m^2$ |
| 1,2-Bnezisothiazoline-3-one (pH: 7.4, adjusted by NaOH) | 0.0005 $g/m^2$ |

(P-1)

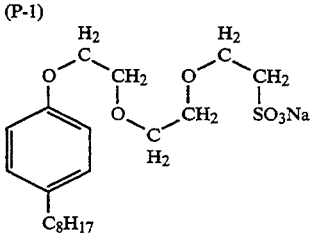

(P-2)

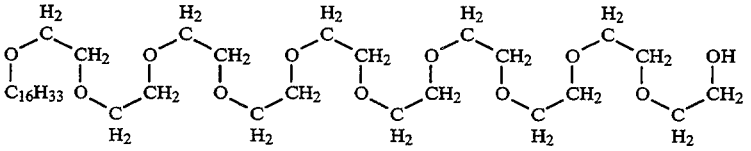

(P-3)

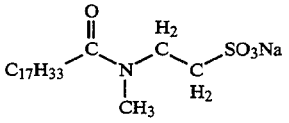

(P-4)

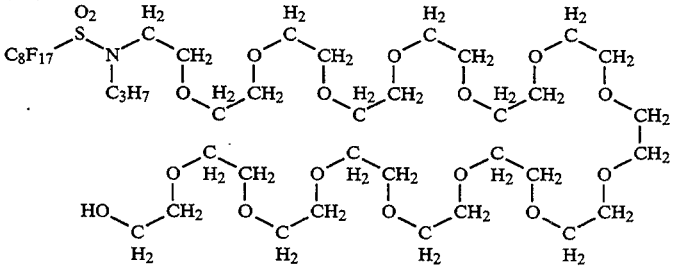

-continued (P-5)

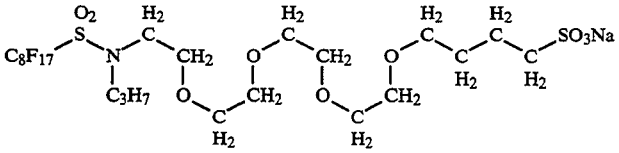

Preparation of a Dye Dispersion

Into a 2-liter ball mill were introduced 434 ml of water and 791 ml of a 6.7% aqueous solution of a surface active agent (Triton X-200 TM). To the resulting solution was added 20 g of the following dye A. To the resulting mixture was added 400 ml of zirconium oxide (ZrO) beads (diameter: 2 mm), and the content in the ball mill was pulverized for 4 days. Then 160 g of 12.5% gelatin was added to the mixture. After defoaming, ZrO beads were removed by filtration. As a result of observation of the obtained dye dispersion, the dispersion had such a wide particle size distribution that diameters of the pulverized dye particles were in the range of 0.05 to 1.15 μm, and a mean particle diameter of the dye particles was 0.37 μm.

Further, the dye dispersion was subjected to centrifugal separation to remove dye particles having diameters of not less than 0.9 μm.

Thus, a dye dispersion was obtained.

Dye (A)

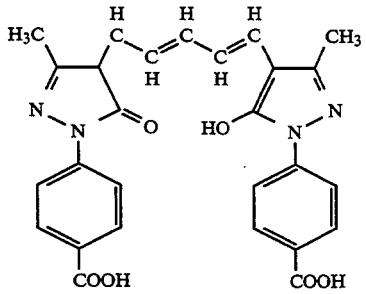

Preparation of a Support

One surface of a biaxially oriented polyethylene terephthalate film having a thickness of 183 μm (containing 0.04 wt. % of the following dye B) was subjected to corona discharge. This surface was coated with a first undercoating solution having the following composition in an amount of 5.1 cc/m$^2$ using a wire bar coater, and the coated layer was dried at 175° C. for 1 minute. Then, on the other surface of the film was provided a first undercoating layer in the same manner as described above.

(Dye B)

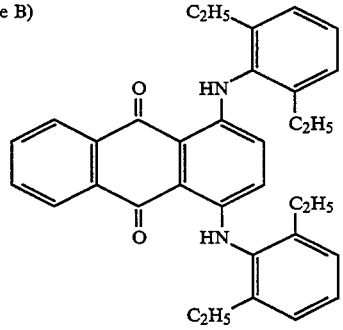

| | |
|---|---|
| Butadiene-styrene copolymer latex solution (solid content: 40%, butadiene/styrene = 31/26 by weight) | 79 cc |
| 4% Solution of 2,4-dichloro-6-hydroxy-s-triazine sodium salt | 20.5 cc |
| Distilled water | 900.5 cc |
| Emulsifying-dispersing agent shown below (0.4 wt. % based on latex solid content) | |

(Emulsifying-dispersing agent)

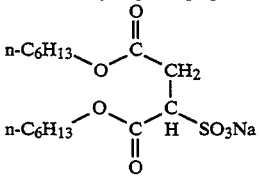

A second undercoating layer having the following composition was coated on free surfaces of the above first undercoating layers one after another in such a manner that the amounts of the components would be the followings using a wire bar coater, and the coated layers were dried at 150° C.

| | |
|---|---|
| Gelatin | 160 mg/m$^2$ |
| Dye dispersion | (dye solid content: 26 mg/m$^2$) |
| Surface active agent shown below | 8 mg/m$^2$ |
| Additive shown below | 0.27 mg/m$^2$ |
| Matting agent (polymethyl methacrylate particles having a mean particle diameter of 2.5 μm) | 2.5 mg/m$^2$ |

(Surface active agent)

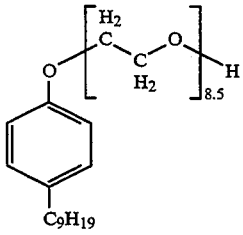

(Additive)

-continued

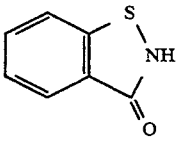

Preparation of Light-Sensitive Materials

On both surfaces of the above support, the aforementioned emulsion layer and surface protective layer were coated by means of a simultaneous extrusion method. The amount of silver on one surface was 1.75 g/m$^2$. Thus, photographic light-sensitive materials 1 to 15 were prepared.

Evaluation of Photographic Light-Sensitive Materials

The above-prepared photographic light-sensitive materials were exposed from both sides for 0.05 second using X-ray ortho-screen HR-4 (available from Fuji Photo Film Co., Ltd.). After the exposure, the photographic light-sensitive materials were subjected to the following processes to evaluate sensitivities. Each of the sensitivities was based on the sensitivity of the sample number 1, and expressed by a reciprocal ratio of the exposure amount providing a density of 1.0 in addition to fogging.

Automatic developing machine

CEPROS-M produced by Fuji Photo Film Co., Ltd. (The driving motor and the gear portion were altered to increase a conveying speed.)

| Concentrated developing solution | |
|---|---|
| Potassium hydroxide | 56.6 g |
| Sodium sulfite | 200 g |
| Diethylenetriamine pentaacetate | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 22.0 g |
| 5-Methylbenzotriazole | 0.2 g |
| Compound (D-1) shown below | 0.6 g |
| Water to make up to (adjusted to pH 10.60) | 1 liter |

(D-1)

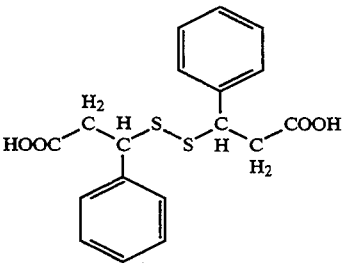

| Concentrated fixing solution | |
|---|---|
| Ammonium thiosulfate | 560 g |
| Sodium sulfite | 60 g |
| Disodium ethylenediamine tetraacetate dihydrate | 0.10 g |
| Sodium hydroxide | 24 g |
| Water to make up to (adjusted to pH 5.10) | 1 liter |

| Developing tank | |
|---|---|
| Concentrated developing solution described above | 333 ml |
| Water | 667 ml |
| Starter containing 2 g of potassium bromide and 1.8 g of acetic acid (adjusted to pH 10.25) | 10 ml |

| Fixing tank | |
|---|---|
| Concentrated fixing solution described above | 200 ml |
| Water | 800 ml |

| | |
|---|---|
| Processing speed (Dry to Dry) | 30 sec |
| Developing temperature | 35 °C. |
| Fixing temperature | 32 °C. |
| Drying temperature | 45 °C. |
| Replenisher of developing solution | 22 ml/10 × 12 in. |
| Replenisher of fixing solution | 30 ml/10 × 12 in. |

Evaluation of Dye Desorption

After completion of the chemical sensitization, the emulsion was dissolved at 40° C., and various additives were added thereto to prepare coating solutions. The coating solutions were stirred for 6 hours keeping at 40° C. Then, they were coated in the same manner as described before. The absorbances of thus coated films at 550 run (peaks of J-bands of the sensitizing dye) were compared with that of the film coated without nitrogen-containing heterocyclic compound as stabilizer. The results are set forth in Table 2. In Table 2, the absorbance is expressed by a relative value based on the peak of the sample 1 being 100. With respect to the samples 1 and 11, there was no difference in the peak of J-band of the dye between the film coated with the coating solution after 6-hour stirring and the film coated with the coating solution immediately after addition of the additives.

Evaluation on Storage Stability

Each of the samples was placed in a sealed container whose bottom portion was charged with a saturated aqueous solution of sodium nitrate. (The sample was not in contact with the aqueous solution.) Each of the samples in the container was stored for 5 days at 50° C. (A humidity in the container was kept at 68%.) Then, the same processes as those used for the evaluation of photographic properties were carried cut, to measure increase of the density in the fogged portion. The results are set forth in Table 2.

TABLE 2

| Sample No. | Silver Halide Particle No. (AgI content) | Coating Solution | Dye Desorption | Storage Stability | Sensitivity |
|---|---|---|---|---|---|
| 1 (Comp. Ex.) | 1 (0.83 mol %) | A | 100 | 0.12 | 100 |
| 2 (Comp. Ex.) | 1 (0.83 mol %) | B-1 | 56 | 0.02 | 69 |
| 3 (Example) | 1 (0.83 mol %) | C-1 | 100 | 0.01 | 112 |
| 4 (Example) | 1 (0.83 mol %) | D-1 | 102 | 0.02 | 105 |
| 5 (Example) | 1 (0.83 mol %) | E-1 | 105 | 0.02 | 108 |
| 6 (Comp. Ex.) | 1 (0.83 mol %) | B-2 | 52 | 0.00 | 50 |
| 7 (Comp. Ex.) | 1 (0.83 mol %) | C-2 | 82 | 0.01 | 78 |
| 8 (Comp. Ex.) | 1 (0.83 mol %) | D-2 | 70 | 0.01 | 60 |
| 9 (Comp. Ex.) | 1 (0.83 mol %) | E-2 | 78 | 0.01 | 72 |
| 10 (Example) | 1 (0.83 mol %) | F | 101 | 0.02 | 104 |
| 11 (Comp. Ex.) | 2 (1.67 mol %) | A | 105 | 0.10 | 120 |

TABLE 2-continued

| Sample No. | Silver Halide Particle No. (AgI content) | Coating Solution | Dye Desorption | Storage Stability | Sensitivity |
|---|---|---|---|---|---|
| 12 (Comp. Ex.) | 2 (1.67 mol %) | B-1 | 73 | 0.02 | 78 |
| 13 (Example) | 2 (1.67 mol %) | C-1 | 106 | 0.01 | 128 |
| 14 (Example) | 2 (1.67 mol %) | D-1 | 104 | 0.02 | 121 |
| 15 (Example) | 2 (1.67 mol %) | E-1 | 105 | 0.02 | 126 |

As is shown in Table 2, it has been confirmed that the dye is desorbed by adding only the nitrogen-containing heterocyclic compound as a stabilizer to the silver halide emulsion (comparison between the sample No. 1 and the sample No. 2 or 6, or comparison between the sample No. 11 and the sample No. 12). At the same time, the sensitivity of the emulsion is also reduced. In contrast thereto, it has been confirmed that in the case of forming a complex using a Ni compound, a Co compound or a Mn compound in combination, neither dye desorption nor reduction of the sensitivity is caused (comparison between the sample No. 2 and the sample No. 3, 4, 5 or 10, or comparison between the sample No. 12 and the sample No. 13, 14 or 15).

Further, the sample No. 2 using the silver halide grains No. 1 having a low content of silver iodide shows larger dye desorption caused by the nitrogen-containing heterocyclic compound, as compared with the sample No. 12 using the silver halide grains 2 having a high content of silver iodide. However, as is evident from the result on the sample No. 2, 3, 4 or 10, the dye desorption can be completely prevented by using the complex of the invention as a stabilizer even in the case of the silver halide grains No. 1.

In the case of using the nitrogen-containing heterocyclic compound having a mercapto group in the form of a complex, however, the dye desorption and the reduction of sensitivity cannot be completely prevented (result on the sample No. 7, 8 or 9). This is probably caused by that the mercapto group has high adsorptivity on the silver halide.

We claim:

1. A silver halide photographic light-sensitive material which comprises a spectrally sensitized silver halide emulsion layer and a non-light-sensitive layer provided on a support, said silver halide emulsion layer containing silver halide grains having a silver iodide content of not more than 1 mole %, wherein the silver halide emulsion layer or the non-light-sensitive layer contains a complex of Ni, Co, Mn or Zn with a nitrogen-containing heterocyclic compound, said complex being formed from a reaction of the heterocyclic compound with a metal salt of Ni, Co, Mn or Zn, and said heterocyclic compound being represented by the following formula:

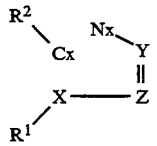

wherein

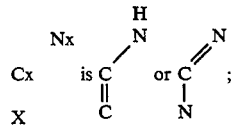

Y is $CR^3$ or N; Z is $CR^4$ or N; each of $R^1$ $R^2$, $R^3$ and $R^4$ independently is hydrogen a halogen atom, hydroxyl, amino, hydroxyamino, cyano, an alkyl group, an aryl group, an alkylthio group, an alkylamino group, an arylamino group, an alkoxycarbonyl group or an acylamino group; $R^1$ and $R^2$ with X and Cx may form a benzene ring or a six-membered nitrogen-containing heterocyclic ring; and the benzene ring or the six-membered nitrogen-containing heterocyclic ring may be substituted with a halogen atom, hydroxyl, amino, hydroxyamino, cyano, an alkyl group, an aryl group, an alkylthio group, an alkylamino group, an arylamino group, an alkoxycarbonyl group or an acylamino group; and wherein the layer containing the complex is formed by adding the complex to a coating solution for the layer and coating the solution on the support.

2. The photographic light-sensitive material as claimed in claim 1, wherein at least one of X, Y and Z is nitrogen.

3. The photographic light-sensitive material as claimed in claim 1, wherein $R^1$ and $R^2$ with X and Cx form a benzene ring or a six-membered nitrogen-containing heterocyclic ring.

4. The photographic light-sensitive material as claimed in claim 1, wherein each of $R^1$, $R^2$, $R^3$ and $R^4$ has 20 or less carbon atoms.

5. The photographic light-sensitive material as claimed in claim 1, wherein the substituent group of the benzene ring or the nitrogen-containing heterocyclic ring of 6 members has 20 or less carbon atoms.

6. The photographic light-sensitive material as claimed in claim 1, wherein at least one of $R^1$, $R^2$, $R^3$, $R^4$ and the substituent group of the benzene ring or the six-membered nitrogen-containing heterocyclic ring is hydroxyl.

7. The photographic light-sensitive material as claimed in claim 1, wherein the nitrogen-containing heterocyclic compound has a hydroxytetrazaindene ring.

8. The photographic light-sensitive material as claimed in claim 1, wherein the nitrogen-containing heterocyclic compound is contained in the complex in an amount of $1\times10^{-5}$ to $1\times10^{-1}$ mol based on 1 mol of silver.

9. The photographic light-sensitive material as claimed in claim 1, wherein Ni, Co, Mn or Zn in the complex is Ni, Co or Mn.

10. The photographic light-sensitive material as claimed in claim 1, wherein the metal salt is formed from Ni, Co, Mn or Zn with a halide ion, phosphate ion, nitrate ion, sulfate ion, an amidosulfate ion, a sulfonate ion or a carboxylate ion.

11. The photographic light-sensitive material as claimed in claim 1, wherein Ni, Co, Mn or Zn is contained in the complex in an amount of 1/6 to 100 mol based on 1 mol of the heterocyclic compound.

12. The photographic light-sensitive material as claimed in claim 1, wherein Ni, Co, Mn or Zn is contained in the complex in an amount of $1\times10^{-4}$ to $3\times10^{-2}$ mol based on 1 mol of silver.

13. The photographic light-sensitive material as claimed in claim 1, wherein all layers provided on the support on the side of the silver halide emulsion layer totally contain gelatin in an amount of not more than 1.8 g based on 1 g of silver.

14. The photographic light-sensitive material as claimed in claim 1, wherein the complex is contained in the silver halide emulsion layer, and the silver halide emulsion layer is formed by adding the complex to a silver halide emulsion and coating the emulsion on the support.

15. The photographic light-sensitive material as claimed in claim 14, wherein the complex is added to the silver halide emulsion after chemical sensitization of the emulsion is completed.

16. The photographic light-sensitive material as claimed in claim 14, wherein the complex is added to the silver halide emulsion after chemical sensitization and spectral sensitization of the emulsion are completed.

* * * * *